US006409479B1

(12) United States Patent
Ito et al.

(10) Patent No.: US 6,409,479 B1
(45) Date of Patent: Jun. 25, 2002

(54) VARIABLE DISPLACEMENT PISTON PUMP/MOTOR

(75) Inventors: Takao Ito; Hisanobu Kanamaru, both of Sagamihara (JP)

(73) Assignee: Aida Engineering Co., Ltd. (JP)

( * ) Notice: Subject to any disclaimer, the term of this patent is extended or adjusted under 35 U.S.C. 154(b) by 0 days.

(21) Appl. No.: 09/704,447

(22) Filed: Nov. 2, 2000

(30) Foreign Application Priority Data

Jan. 11, 2000 (JP) ..... 2000-002157

(51) Int. Cl.[7] ..... F04B 9/00; F01B 3/00

(52) U.S. Cl. ..... 417/319; 417/316; 92/71

(58) Field of Search ..... 417/319, 316; 92/71

(56) References Cited

U.S. PATENT DOCUMENTS 4,891,944 A * 1/1990 Okuda et al. ..... 60/489
4,911,063 A * 3/1990 Kawahara et al. ..... 92/12.2
5,072,587 A * 12/1991 Ikejiri et al. ..... 60/488
5,928,098 A * 7/1999 Imamura et al. ..... 475/81

* cited by examiner

*Primary Examiner*—Charles G. Freay
*Assistant Examiner*—Michael K. Gray
(74) *Attorney, Agent, or Firm*—Morrison Law Firm

(57) ABSTRACT

A variable displacement piston pump/motor has a simple, compact structure that is suited for use as an oil-pressure generating device for machine presses and the like. In the variable displacement piston pump/motor, a flywheel and a rotation shaft of a pump device are disposed and connected concentrically.

1 Claim, 3 Drawing Sheets

VARIABLE DISPLACEMENT PISTON PUMP/MOTOR

BACKGROUND OF THE INVENTION

The present invention relates to a variable displacement piston pump motor suited for serving as an oil-pressure source for hydraulic presses and the like.

Japanese laid-open patent publication number 7-118653 describes an example of a variable displacement piston pump/motor that allows the rotational output or the discharge capacity of a pump to be controlled by manipulating the tilting angle (theta) of an input or an output shaft. Japanese laid-open patent publication number 10-18962 describes a swash-plate variable displacement oil-pressure pump that controls a reciprocating axial piston inside a cylinder block by tilting a swash plate forward or back from a neutral position perpendicular to a drive axis using a manually-operated lever.

Japanese laid-open patent publication number 9-42340 discloses a wet clutch/brake device in which an output shaft is kept engaged at all times to a brake plate of a multi-plate brake device. When the output shaft is to be rotated while engaged to a casing, air pressure displaces a cylindrical cylinder toward the output shaft, and rotation takes place via the clutch device with the brake released.

While both Japanese laid-open patent publication number 7-118653 and Japanese laid-open patent publication number 10-18962 allow the pump discharge volume to be changed freely by varying the tiling angle of the swash plate, it is assumed that the pump device will be used by itself and does not consider situations such as when the drive shaft is connected directly to another clutch device. Also, the latter publication is solely a wet clutch/brake device for machine presses, and no consideration is made for directly connecting to a variable displacement piston pump/motor.

OBJECTS AND SUMMARY OF THE INVENTION

The object of the present invention is to provide an energy-conserving variable displacement piston pump/motor with a compact, simple structure that is suited for serving as an oil-pressure generating for machine presses and the like.

Another object of the present invention is to provide an energy-conserving variable displacement piston pump/motor with a compact, simple structure that can be efficiently started and stopped.

According to one aspect, the present invention provides a variable displacement piston pump/motor wherein rotation energy accumulated in a flywheel is transferred via a clutch device to a pump device to provide rotation and generate oil pressure. A drive shaft of the pump device is rotated via the flywheel is disposed and connected concentrically with a driven shaft.

In the present invention, a flywheel is disposed in an overlapping manner concentrically with the pump drive shaft and equipped with a clutch that opens and closes a connection to the pump device and a brake device accelerating the stopping of the pump device. In the present invention, the driven shaft and the drive shaft of the pump device are connected by a coupling.

According to another aspect, the present invention provides a variable displacement piston pump/motor wherein rotation energy accumulated in a flywheel is transferred via a clutch device to a pump device to provide rotation and generate oil pressure. The variable displacement piston pump/motor includes: an electric motor; a cylindrical boss rotatably supporting a drive shaft of a pump rotated by an electric motor and fixed on fixed frames serving as side walls; a hollow flywheel rotatably supported on an outer perimeter of the cylindrical boss, disposed in an overlapping manner concentrically with the cylindrical boss and the pump drive shaft, and rotating integrally with an input shaft rotated by the output from the electric motor; a multiplate clutch device interposed between an inner perimeter end surface of the flywheel and an inner perimeter end surface of pump drive shaft; a multi-plate brake device disposed parallel to the multi-plate clutch device and interposed between the outer perimeter of the pump drive shaft and a fixed support plate formed integrally with the cylindrical boss; a driven shaft connected with a coupling to the pump drive shaft; an oil suction opening and a discharge opening disposed radially and driven by the driven shaft; and a pump device including a variable displacement operation mechanism toward the outside from the axial line.

DETAILED DESCRIPTION OF THE PREFERRED EMBODIMENTS

Figure 1:
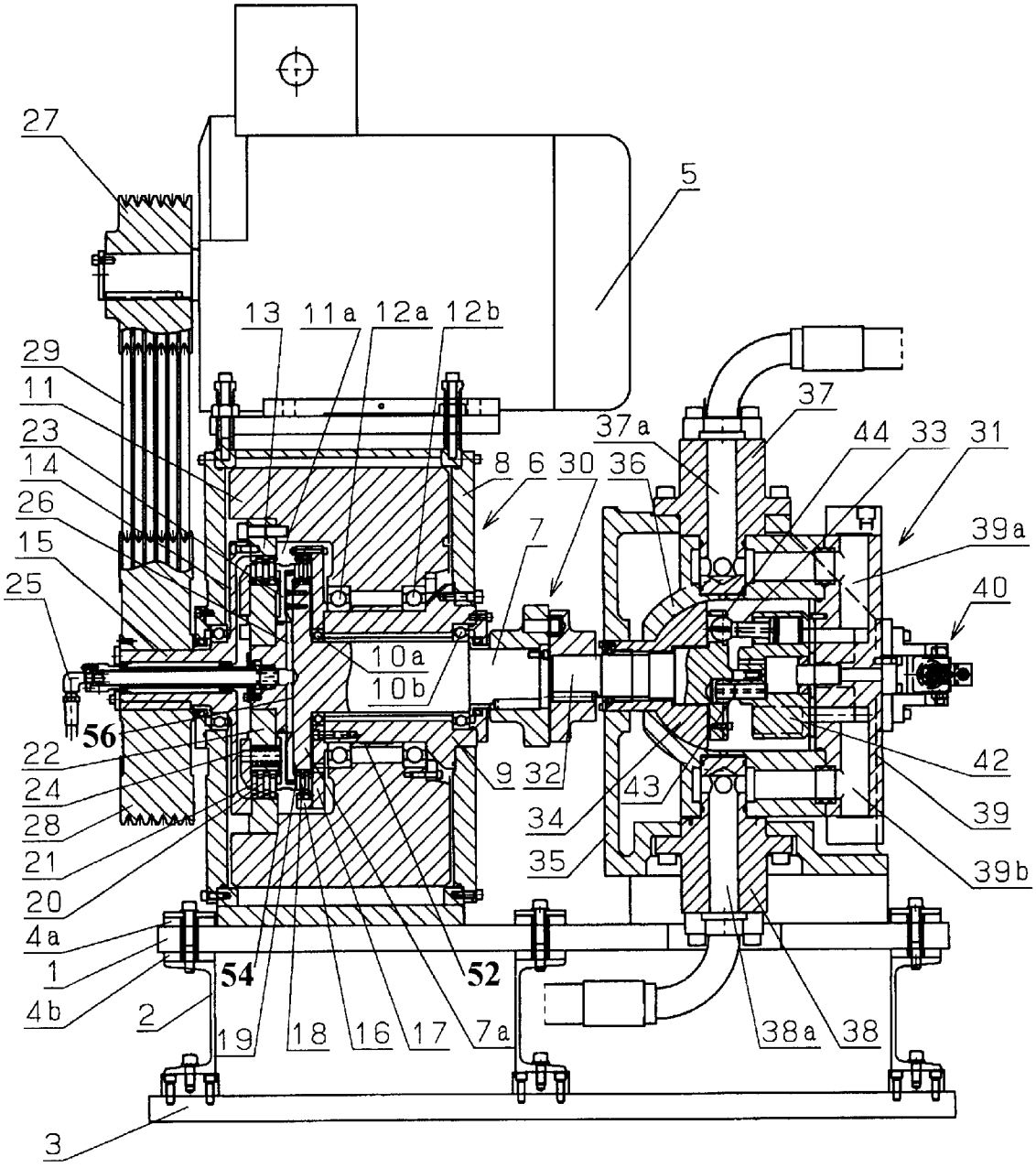
FIG. 1 is a schematic vertical cross-section drawing of a variable displacement piston pump/motor according to an embodiment of the present invention.

Referring to FIG. 1, a base 1 of a variable displacement piston pump/motor is fixed to a floor 3 via attachment legs 2 disposed at a plurality of positions. In order to prevent vibrations and noise, the attachment legs 2 are screwed onto the contacting surfaces of the base with the standard vibration-preventing members 4*a*, 4*b* interposed therebetween. An electric motor 5, an oil-pressure motor, or the like can be used as the source of rotation power. In this case, an electric motor is used.

The following is a description of the structure of a pump driver 6. A pump drive shaft 7 is passed through a cylindrical boss 9 fixed at the center of a fixed frame 8 and is rotatably supported via a pair of bearings 10*a*, 10*b* disposed on the inner perimeter of the cylindrical boss 9.

A hollow flywheel 11 is disposed so that it is concentrically overlapped with the pump drive shaft 7 and the cylindrical boss 9. The flywheel 11 is rotatably supported by a pair of bearings 12*a*, 12*b* disposed on the outer perimeter 52 of the cylindrical boss 9. The end surface at one end of the flywheel 11 forms an offset space 11 a and is connected via a clutch body 13 and a connecting plate 14 to an input shaft 15. The input shaft 15 is rotatably supported on the other fixed frame.

Next, the clutch/brake device disposed in the offset space 11 a will be described. The multi-plate clutch device is interposed between an inner perimeter end surface 54 of flywheel 11 and an inner perimeter end surface 56 of pump drive shaft 7. A clutch body 16 is attached to a disc-shaped fixing plate 17, which is bolted onto the outer perimeter side surface of the brake body 16. The brake friction plates 18 are attached to the inner perimeter surface of the brake body 16. The brake friction plates 18 can slide along the axial direction but are restricted from sliding in the rotation direction. Brake disks 19, which are disposed in an alternating manner with the brake friction plates 18, can slide along the axial direction along the inner perimeter while sliding along the rotation direction is restricted. The brake discs 19 are attached to the outer perimeter of a collar 7*a* formed at one end of the pump drive shaft 7.

A plurality of clutch friction plates 20 are attached to the inner perimeter surface of the clutch body 13. The clutch friction plates 20 can slide along the axial direction but sliding along the rotation direction is restricted. Clutch disks 21 are disposed in an alternating manner with the clutch friction plates 20. The inner perimeter sections of the clutch disks 21 are attached to the outer perimeter sections of a clutch disk attachment plate attached to one end of the pump drive shaft 7. The clutch disks 21 can slide in the axial direction and are restricted from sliding in the rotational direction.

A piston 23 includes a pushing section at the outer perimeter thereof and is slidably supported o the pump drive shaft 7. The piston 23 is usually pressed between the brake friction plates 18 and the brake disks 19 by a spring 24. The displacement of the spring 23 takes place by the air pressure supplied through a path 26 formed in the pump drive shaft 7 and a guide pipe 25 disposed at the center of the input shaft 15. The electric motor 5 is fixed with bolts or the like to the perimeter of the fixed frame 8 via attachment legs. The output therefrom is transferred through pulleys 27, and a belt 29 to the input shaft 15.

Figure 2:
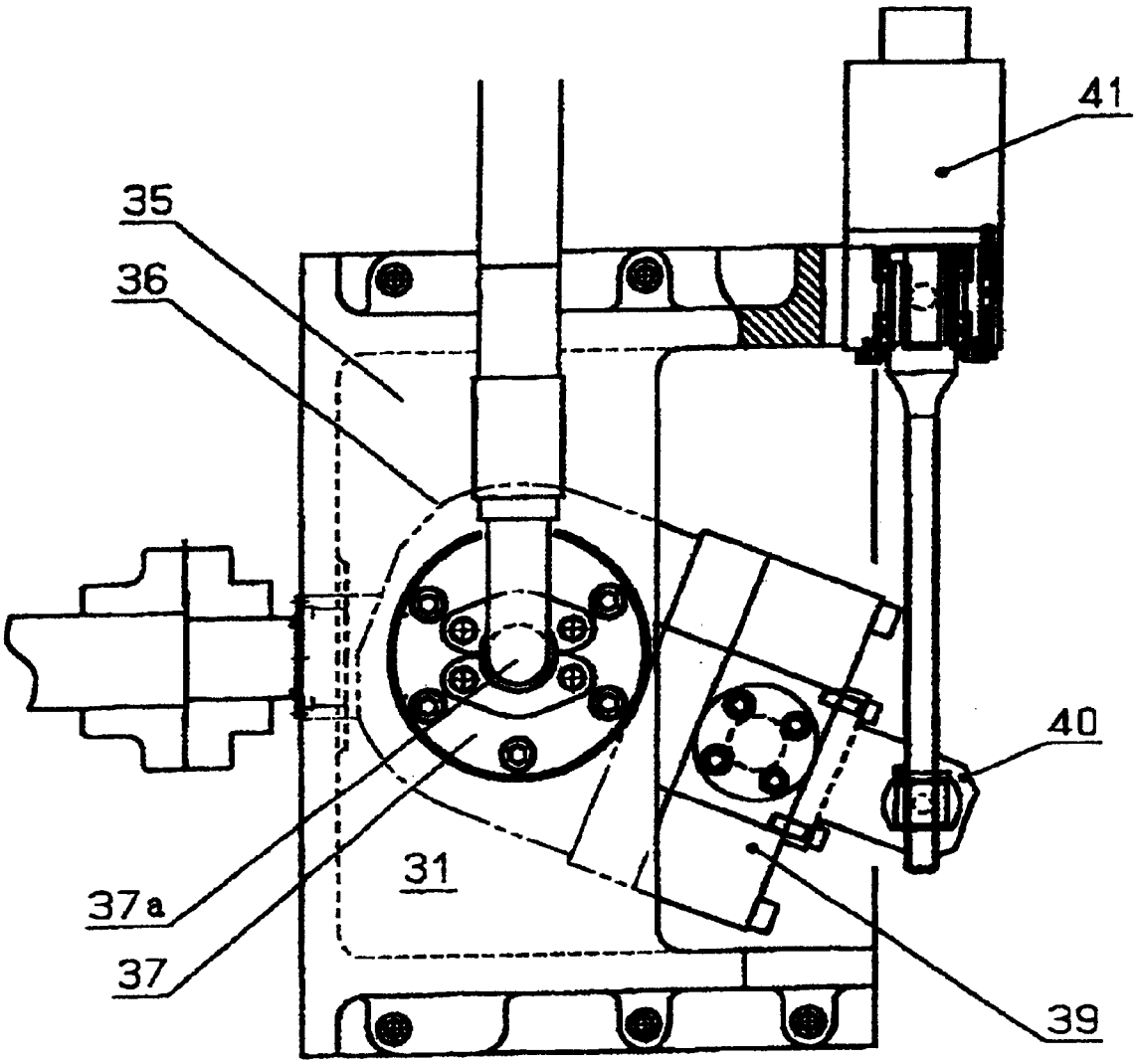
FIG. 2 is a plan view partly in section of the variable displacement piston pump/motor.

A drive shaft 32 of a pump device 31 is connected via a coupling 30 to the pump drive shaft 7. The other end surface of the driven shaft 32 supports the head of a piston 33 and is rotatably supported at the center of a swash plate 34 having a hemispherical surface along the outer perimeter. A cylindrical section at the end of the swash plate 34 is fixed to a fixed frame 35, and the hemispherical surface is rotatably supported by a housing 36. The housing 36 is supported by an oil suction pipe 37 and an oil discharge pipe 38, which are disposed on opposing radial sides, so that it can rotate in one direction only (horizontally in the figure). The open end of the housing 36 is covered by an end plate 39, which is formed with a path 39*a* communicating with a suction path 37*a* and a path 39*b* communicating with a discharge path 38*a*. Referring to FIG. 2, this plate 39 includes a lever attachment mechanism 40 used to tilt the housing 36. The lever is actuated using the rotational force of a standard electric motor 41, but manual operation is acceptable for low capacity units. As is generally known, a cylinder barrel 42 of the pump unit is rotatably supported on the inner side surface of the end plate 39, and a drive pin 43 is disposed to allow any rotation angle relative to the driven shaft 32.

One end of the piston 33 is rotatably supported by a piston support 44, and the other end is slidably supported by a cylinder bore in a tightly sealed manner. In the structure described above, the rotation output of the electric motor 5 is transferred to the pulley 27, 28, the drive belt 29, the input shaft 15, the connecting plate 14, the clutch body 13, and the flywheel 11. While the clutch friction plate 20 and the clutch disk 21 are disengaged due to the restoring spring 24, the flywheel 11 continues rotating due to the rotation force of the electric motor and the inertia accumulated in the flywheel 11.

Figure 3:
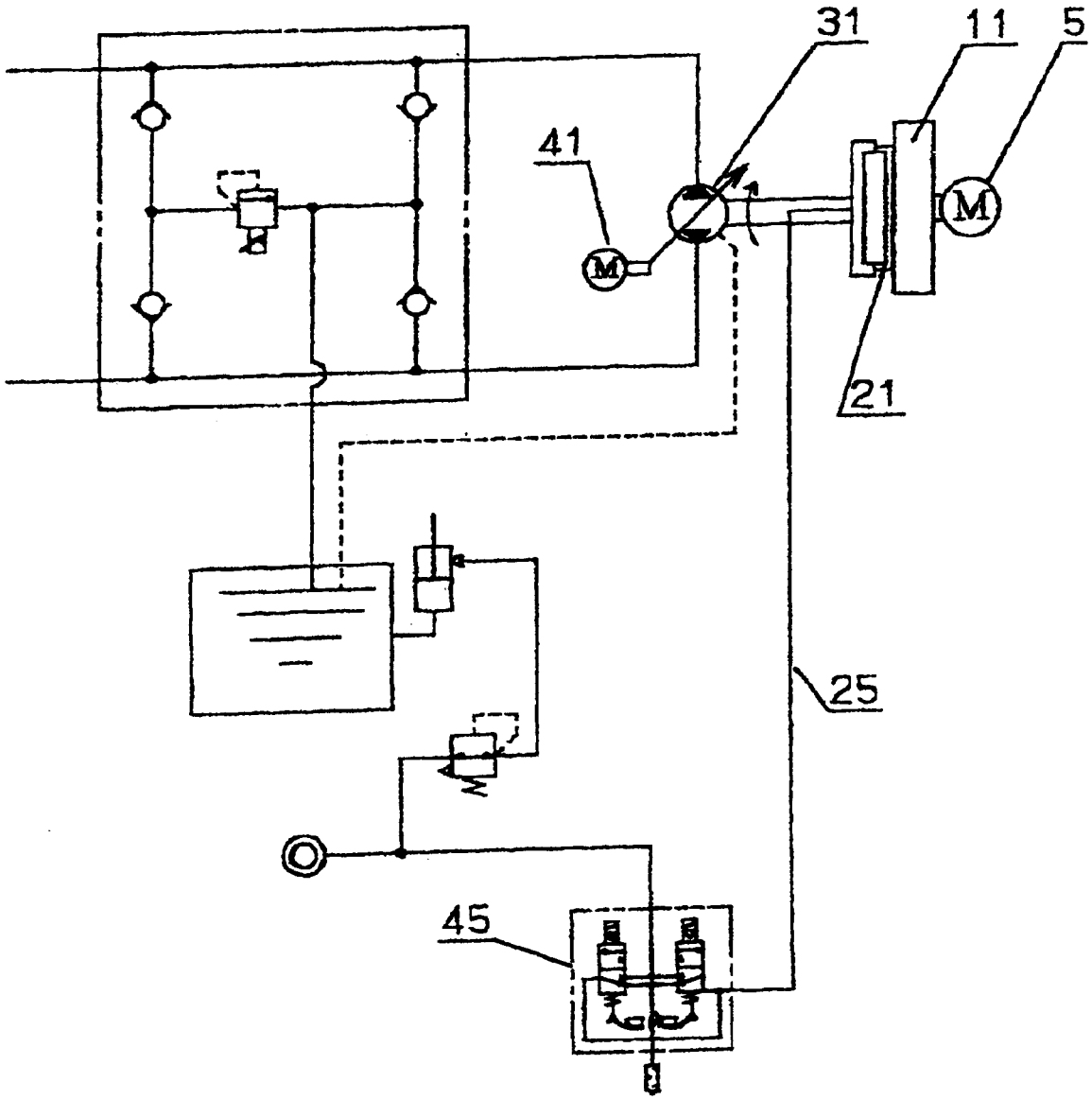
FIG. 3 is a circuit diagram of the oil pressure flow in an embodiment of the present invention.

Referring to the circuit shown in FIG. 3, air pressure goes from an air pressure source 45 through a path 26 of a guide pipe 25 and reaches the piston 23. The piston 23 compresses the piston restoring spring 24, bonding the clutch disks 21 and the friction plates 20 of the clutch device while releasing the brake disks 19 from the brake friction plates 18 of the brake device. Thus, the rotation force of the flywheel 11 is transferred from the pump drive shaft 7 to the driven shaft 32 of the pump device 31 and the drive pin 43 and reaches the cylinder barrel 42 where it results in rotation. However, as long as these parts lie along a single line the piston will not be activated and there will be no movement of the active oil, and no oil pressure will be generated.

In order to serve as an oil pressure source for an oil-pressure servo motor or the like, the lever attachment mechanism 40 is operated manually or with an electric motor 41 (servo motor) in order to tilt the housing 36 and the cylinder barrel 42 of the pump device 31 by a fixed amount. The tilting angle determines the maximum/minimum range for the pump discharge volume. With the axis of the cylinder barrel 42 tilted relative to the driven shaft 32, the rotation force is transferred via the drive pin 43 to the cylinder barrel 42 so that the piston 33 makes a reciprocating motion, oil is sucked in from the discharge pipe 38, and the load on the connected pump motor or the like is driven. The tilting of the cylinder barrel 42 is performed by rotating the housing 36 of the pump device with the suction and discharge pipes 37, 38 serving as the rotation axis. Thus, the tilting can be performed with no external force to the main elements of the pump device, and a highly reliable and well-sealed pump structure can be maintained. In the embodiment described above, the pump drive shaft and the driven shaft of the pump are connected by a coupling, but it would also be possible to fit the drive shafts together while performing rotation stoppage to prevent rotation. With relatively small capacities, the brake device can be eliminated so that only a clutch device is used while still providing an energy-conserving, low-noise device. In particular, low-capacity models can have the pump device operated manually. This can be selected appropriately based on the application.

According to the present invention, a drive shaft of a variable displacement piston pump/motor that rotates using a flywheel can be connected concentrically to a driven shaft of a pump device. This provides an energy-conserving variable displacement piston pump/motor having a simple and compact structure.

According to the present invention, the flywheel can be disposed so that it is overlapped with and concentric to the pump drive shaft. The present invention can also be equipped with a clutch that opens and closes the connection to the pump device and a brake device that accelerates the stopping of the pump device. This provides a compact, low-noise variable displacement piston pump/motor.

According to the present invention, the drive shaft and the driven shaft can be connected with a coupling, thus providing a variable displacement piston pump/motor with superior transmission efficiency.

According to the present invention, a variable displacement piston pump/motor can include: an electric motor; a cylindrical boss rotatably supporting a drive shaft of a pump rotated by the electric motor and fixed to the fixed frames serving as side walls; a hollow flywheel rotatably supported on the outer perimeter of the cylindrical boss, disposed in an overlapping manner with and concentric to the pump drive shaft, and rotating integrally with an input shaft, driven by the output from the electric motor; a multi-plate clutch device interposed between an inner perimeter end surface of the flywheel and an outer perimeter end surface of the pump drive shaft; a multi-plate brake device disposed parallel to the multi-plate clutch device and interposed between the outer perimeter of the pump drive shaft and fixed support plates formed integrally with the cylindrical boss; a driven shaft connected by a coupling to the pump drive shaft; and a pump device driven by the driven shaft and including an oil suction opening and a discharge opening, which are radially disposed and also including a variable displacement operating mechanism disposed outwardly along the axial line. This provides an energy-conserving variable displacement piston pump/motor that can be efficiently started and stopped.

What is claimed is:

1. In a variable displacement piston pump/motor wherein rotation energy accumulated in a flywheel is transferred via a clutch device to a pump device to provide rotation and generate oil pressure, a variable displacement piston pump/motor comprising:

an electric motor;

a cylindrical boss supporting a drive shaft of a pump, said pump drive shaft being rotated by said electric motor and fixed on fixed frames serving as side walls;

a hollow flywheel rotatably supported on an outer perimeter of said cylindrical boss, disposed overlappingly concentrically with said cylindrical boss and said pump drive shaft, said flywheel rotating integrally with an input shaft rotated by the output from said electric motor;

a multi-plate clutch interposed between an inner perimeter end surface of said flywheel and an inner perimeter end surface of pump drive shaft;

a multi-plate brake device disposed parallel to said multi-plate clutch device and interposed between an outer perimeter of said pump drive shaft and a fixed support plate formed integrally with said cylindrical boss;

a driven shaft connected with a coupling to said pump drive shaft; and an oil suction path and an oil discharge path disposed radially of said driven shaft; and a pump device including a variable displacement operating mechanism.

* * * * *